United States Patent [19]

Nishikawa et al.

[11] Patent Number: 4,703,291

[45] Date of Patent: Oct. 27, 1987

[54] DIELECTRIC FILTER FOR USE IN A MICROWAVE INTEGRATED CIRCUIT

[75] Inventors: Toshio Nishikawa, Nagaokakyo; Tadahiro Yorita, Kanazawa, both of Japan

[73] Assignee: Murata Manufacturing Co., Ltd., Kyoto, Japan

[21] Appl. No.: 837,765

[22] Filed: Mar. 10, 1986

[30] Foreign Application Priority Data

Mar. 13, 1985 [JP] Japan ..... 60-51293

[51] Int. Cl.[4] ..... H01P 1/202; H01P 1/203; H01P 7/04

[52] U.S. Cl. ..... 333/202; 333/204; 333/206; 333/222; 333/245

[58] Field of Search ..... 333/202, 204–207, 333/219, 222, 223, 245, 246, 235

[56] References Cited

U.S. PATENT DOCUMENTS 4,342,972 8/1982 Nishikawa et al. ..... 333/222
4,361,820 11/1982 Sagawa et al. ..... 333/222 X
4,431,977 2/1984 Sokola et al. ..... 333/206

FOREIGN PATENT DOCUMENTS 0052601 4/1980 Japan ..... 333/206
0114901 7/1984 Japan .

*Primary Examiner*—Marvin L. Nussbaum
*Attorney, Agent, or Firm*—Wenderoth, Lind & Ponack

[57] ABSTRACT

A dielectric filter for use in a microwave integrated circuit includes a substrate made of ceramics and a plurality of dielectric resonators mounted on the substrate. The substrate has a ground electrode, input and output strip lines, and a plurality of capacitance electrodes. The dielectric resonator has a body made of a dielectric material with a through hole formed therein, an inner electrode deposited on the wall defining the through hole, and an outer electrode deposited on an outer surface of the body. The inner electrode is electrically connected to the capacitance electrode, and the outer electrode is electrically connected to the ground electrode.

14 Claims, 6 Drawing Figures

DIELECTRIC FILTER FOR USE IN A MICROWAVE INTEGRATED CIRCUIT

BACKGROUND OF THE INVENTION

1. Field of the Invention

The present invention relates to a high frequency filter and, more particularly, to an arrangement of dielectric filter of MIC (microwave integrated circuit) type.

2. Description of the Prior Art

Generally, the dielectric filter of this type has a base plate made of electrically non-conductive material and having a ground electrode, input electrode, output electrode and capacitance electrodes aligned between the input and output electrodes with a predetermined spacing. A plurality of dielectric resonators are mounted on the base plate, each having an outer conductor which is connected to the ground electrode and an inner conductor which is connected to a particular capacitance electrode.

The prior art dielectric filters of the above described type further has a casing mounted on the base plate so as to electrically shield the dielectric resonators. The external connection to the filter is done by terminal pins which are connected to input and output electrodes and ground electrode, respectively. Therefore, the prior art filter is presented in a unit element. Such a prior art dielectric filter is disclosed, for example, in U.S. Pat. No. 4,431,977 to Sokola et al, U.S. Pat. No. 3,121,847 to Pakan and U.S. Pat. Nos. 4,223,287, 4,245,198, 4,276,525, 4,342972, 4,151,494, and 4,546,334 all to Nishikawa et al.

When in use, the prior art dielectric filter is mounted on a substrate on which a microwave integrated circuit (MIC) is formed. The electric connection of the filter unit to the strip line of the MIC is done, for example, by socketing the terminal pins on the filter unit to the sockets formed on the substrate of the MIC. The sockets may be formed on the filter unit and the terminal pins may be formed on the substrate. In any event, it is necessary to form the sockets and terminal pins, which results in the increase of the manufacturing cost. Furthermore, to ensure the connection between the socket and pin, a solder beads may be applied at the connection. This results in the extra manufacturing step. Also, because the connection is done by the socket and pin, it is difficult to make an appropriate impedance matching between the filter unit and the MIC.

SUMMARY OF THE INVENTION

The present invention has been developed with a view to substantially solving the above described disadvantages and has for its essential object to provide an improved arrangement of a dielectric filter which can be directly mounted ont he substrate of the MIC.

It is also an essential object of the present invention to provide a dielectric filter of the above described type which is simple in construction and, can readily be manufactured at low cost.

In accomplishing these and other objects, a dielectric filter according to the present invention comprises a substrate made of ceramics and at least one dielectric resonator mounted on the substrate. The substrate has a ground electrode, input and output strip lines, and a plurality of capacitance electrodes. The dielectric resonator has a body made of a dielectric material with a through hole formed therein, an inner electrode deposited on the wall defining the through hole, and an outer electrode deposited on an outer surface of the body. The inner electrode is electrically connected to the capacitance electrode, and the outer electrode is electrically connected to the ground electrode.

BRIEF DESCRIPTION OF THE DRAWINGS

These and other objects and features of the present invention will become apparent from the following description taken in conjunction with preferred embodiments thereof with reference to the accompnaying drawings, throughout which like parts are designated by like reference numerals, and in which.

DESCRIPTION OF THE PREFERRED EMBODIMENTS

Figure 1:
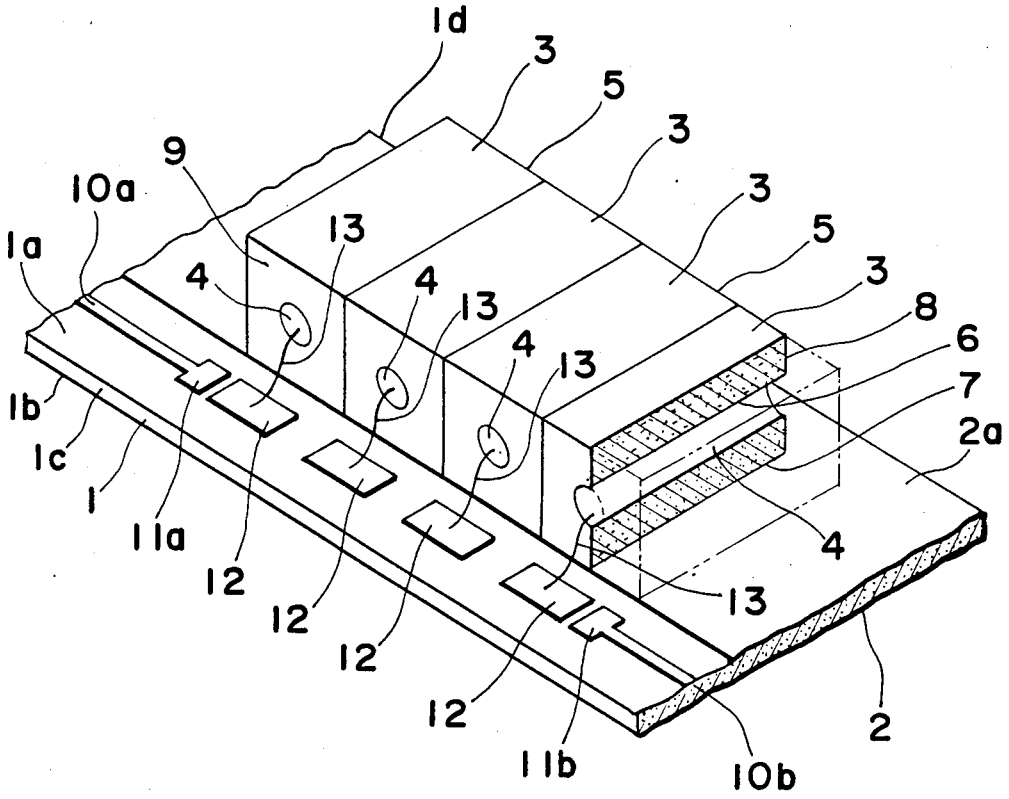
FIG. 1 is a fragmentary perspective view partly removed of a circuit board for MIC, particularly showing a dielectric filter arrangement, according to the first embodiment of the present invention.
Figure 2:
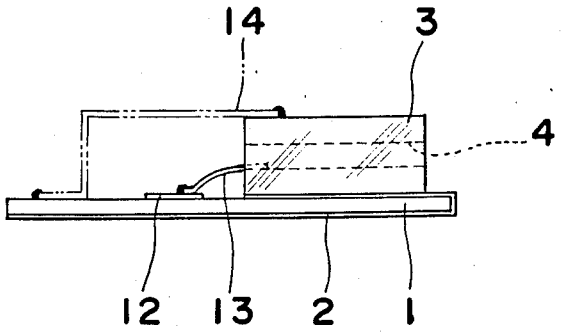
FIG. 2 is a side elevtional view of the dielectric filter mounted on the circuit board.

Referring to FIG. 1, a dielectric filter according to the first embodiment of the present invention is shown. A substrate 1 made of dielectric material, such as ceramics, has first and second faces 1*a* and 1*b* and parallel sides 1*c* and 1*d*. A ground electrode 2 is deposited entirely on the second face 1*b*, side 1*d* and a part of first face 1*a*, as shown in FIGS. 1 and 2. A portion of first face 1*a* where ground electrode 2 is not provided, is deposited with input strip line 10*a*, input electrode 11*a* continuing from input strip line 10*a*, output strip line 10*b*, output electrode 11*b* continuing from output strip line 10*b*, and a plurality of, for example four, shown in FIG. 1, capacitance electrodes 12 aligned between the input and output electrodes with a predetermined spacing.

It is to be noted that substrate 1 may be further provided with a microwave integrated circuit (not shown) at the extended portions of the input and/or output strip lines.

A plurality of, such as four, dielectric resonators 3 are mounted on first face 1*a* of the substrate over the ground electrode. Each dielectric resonator 3 is defined by an elongated rectangular body 5 made of dielectric material, such as ceramics, with a through hole 4 formed in its axial diretion. The four sides of body 5 is deposited with an outer electrode 7 and the inner wall defining the through hole is deposited with an inner electrode 6. The outer and inner electrodes are electrically connected to each other by an electrode 8 deposited at one end face of body 5. The other end face 9 of body 5 remains uncovered by any electrode, so that the loop of the wave appears at the open end 9.

Four dielectric resonators 3 are fixedly laid in parallel with each other on the first face of substrate 1 where ground electrode 2 is deposited, such that the uncovered end face 9 of body 5 is located adjacent each capacitance electrode 12. The electric connection between outer electrode 7 and ground electrode 2 is effected by way of soldering or silver baking.

Furthermore, inner electrode 6 and capacitance electrode 12, which are located close to each other, are electrically connected by a bonding wire 13.

According to the first embodiment, it is possible to further add a shielding cover 14, such as shown by an imaginary line in FIG. 2. Shielding cover 14 has a configuration generally in a shape of L cross-section so that uncovered end faces 9 and capacitance electrodes 12 are covered. Cover 14 not only protects bonding wires 13, but also prevents the leakage of electric flux from electrodes 12. Instead of cover 14, it is possible to place a dielectric plate (not shown) on capacitance electrodes 12 to present a so-called tri-plate structure, thereby preventing the leakage of electric flux from electrodes 12.

Figure 3:
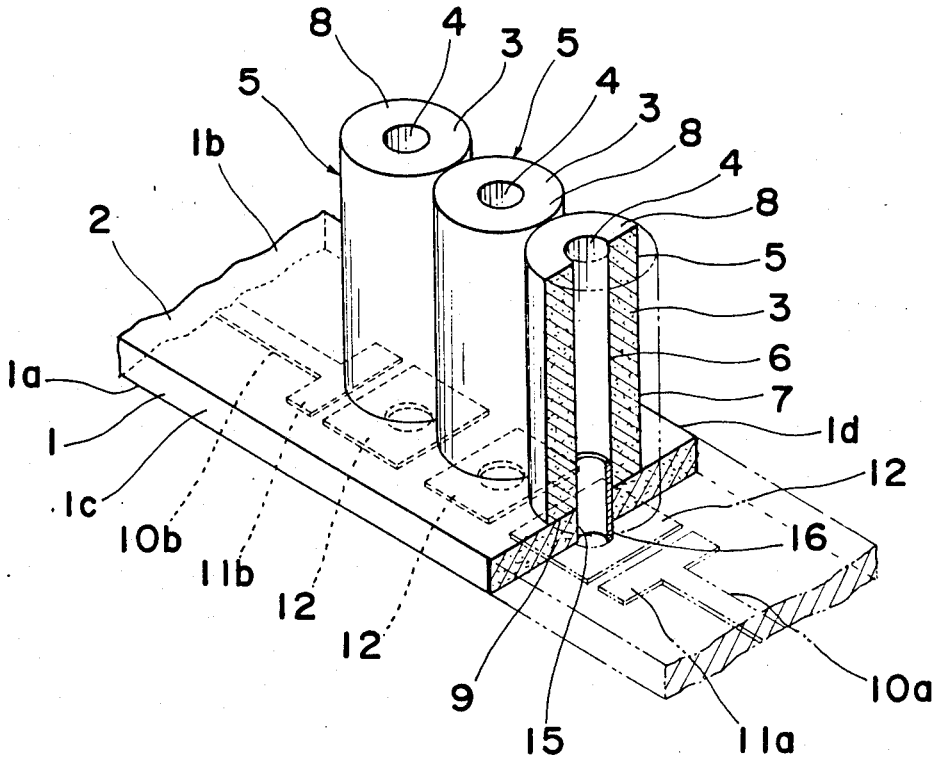
FIG. 3 is a fragmentary perspective view partly removed of a circuit board for MIC, particularly showing a dielectric filter arrangement, according to the second embodiment of the present invention.

Referring to FIG. 3, a dielectric filter according to the second embodiment of the present invention is shown, which is viewed from the bottom. A substrate 1 made of dielectric material, such as ceramics, has first and second faces 1*a* and 1*b* and parallel sides 1*c* and 1*d*. The second face 1*b* is facing upside. A ground electrode 2 is deposited on second face 1*b* leaving a portion at which dielectric resonators are to be mounted. Thus, in the embodiment shown in FIG. 3, the ground electrode is not deposited at three circle places where the cylindrical resonators stand. First face 1*a*, which is shown as facing downward, is deposited with input strip line 10*a*, input electrode 11*a* continuing from input strip line 10*a*, output strip line 10*b*, output electrode 11*b* continuing from output strip line 10*b*, and a plurality of, for example three, shown in FIG. 3, capacitance electrods 12 aligned between the input and output electrodes with a predetermined spacing. At the center of each capacitance electrode 12, a circle opening 15 is formed which extends through the substrate for pressure fittingly inserting a terminal tube 16. One end tube 16 is electrically connected to capacitance electrode 12, for example by soldering. The other end of tube 16 extends outwardly from second face 1*b* of the substrate.

It is to be noted that substrate 1 may be further provided with a microwave integrated circuit (not shown) at the extended portions of the input and/or output strip lines.

A plurality of, such as three, dielectric resonators 3 are mounted on second face 1*b* of the substrate where the ground electrode is not provided. Each dielectric resonator 3 is defined by an elongated cylindrical body 5 made of dielectric material, such as ceramics, with a through hole 4 formed in its axial direction. The side face of body 5 is deposited with an outer electrode 7 and the inner wall defining the through hole is deposited with an inner electrode 6. The outer and inner electrodes are electrically connected by an end electrode 8 deposited at one end face of the cylindrical body 5, remote from the end face connected to the substrate. The other end face 9 of body 5, which is held in contact with the substrate 1 remains uncovered by any electrode, so that the loop of the wave appears at the open end 9.

Each dielectric resonator 3 is fixedly mounted on the second face 1*b* of substrate 1 where ground electrode 2 is not deposited, such that the projecting portion of tube 16 is fittingly inserted into through hole 4 of the resonator. Thus, by tube 16, inner electrode 6 and capacitance electrode 12 are electrically connected. To ensure the connection between tube 16 and dielectric resonator 3, a soldering or a suitable electric conductive bonding agent may be provided therebetween. The electric connection between outer electrode 7 and ground electrode 2 is effected by way of soldering or silver baking.

Figure 4:
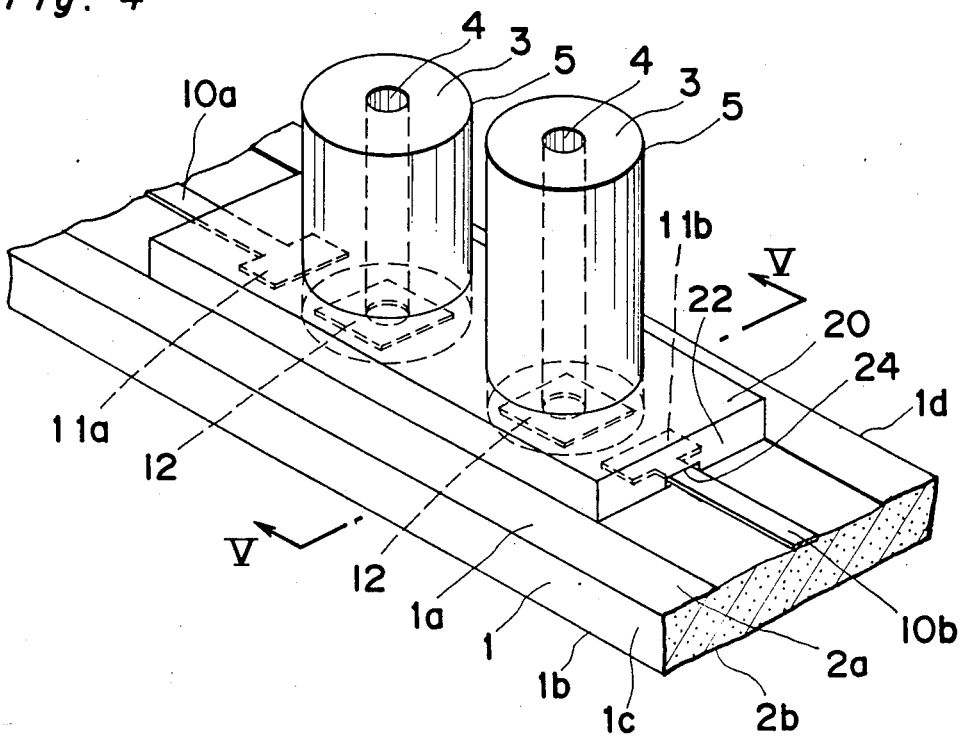
FIG. 4 is a perspective view of a circuit board for MIC, particularly showing a dielectric filter arrangement, according to the third embodiment of the present invention.
Figure 5:
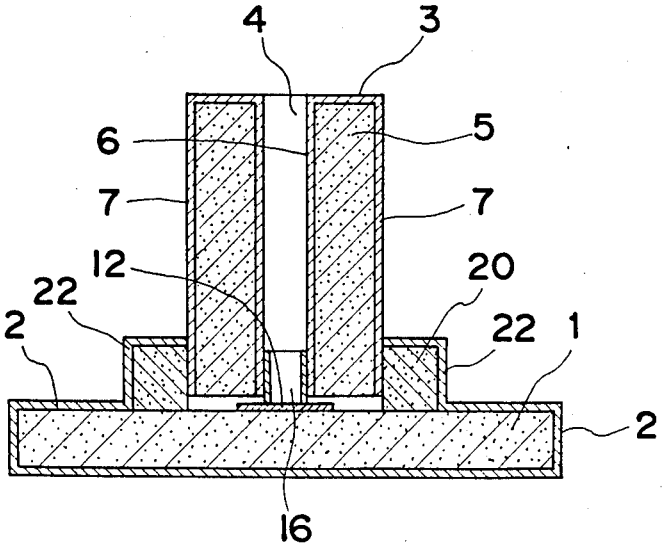
FIG. 5 is a cross-sectional view taken along a line V—V shown in FIG. 4.

Referring to FIGS. 4 and 5, a dielectric filter according to the third embodiment of the present invention is shown. A substrate 1 made of dielectric material, such as ceramics, has first and second faces 1*a* and 1*b* and parallel sides 1*c* and 1*d*. A ground electrode 2 is deposited entirely on the second face 1*b*, sides 1*c* and 1*d* and opposite edge portions of first face 1*a*, as shown in FIGS. 4 and 5. A center portion of first face 1*a* where ground electrode 2 is not provided, is deposited with input strip line 10*a*, input electrode 11*a* continuing from input strip line 10*a*, output strip line 10*b*, output electrode 11*b* continuing from output strip line 10*b*, and a plurality of, for example two, shown in FIG. 4, capacitance electrodes 12 aligned between the input and output electrodes with a predetermined spacing.

It is to be noted that substrate 1 may be further provided with a microwave integrated circuit (not shown) at the extended portions of the input and/or output strip lines.

A plurality of, such as two, dielectric resonators 3 are mounted on first face 1a in a manner described later. Each dielectric resonator 3 has the same structure as that used in the second embodiment.

According to the third embodiment, a cover plate 20 made of dielectric material is mounted on substrate 1 by a suitable adhesive material. The outer surfaces of cover plate 20, other than the surface facing substrate 1, are deposited with a ground electrode 11. Cover plate 20 further has two circle openings so as to fittingly insert the open end portions of dielectric resonators 3. Thus, the input and output electrodes 11*a* and 11*b* are covered by cover plate 20, and capacitance electrodes 12 are covered by the end faces of dielectric resonators 3.

It is to be noted that inner electrode 6 is electrically connected to capacitance electrode 12 through tube 16, and that outer electrode 7, ground electrode 22 and ground electrode 2 are electrically connected to each other, as shown in FIG. 5. However, input and output strip lines 10*a* and 10*b* should not be electrically connected to ground electrode 22. To this end, ground electrode 22 may be recessed, as shown at 24 in FIG. 4. If the input and output strip lines 10*a* and 10*b* can be electrically insulated from ground electrode 22, such recesses 24 are not necessary.

In the third embodiment, since cover plate 20 is provided, a leakage of RF (radio frequency) signal from a space between the open end faces of the dielectric resonators and capacitance electrodes 12 can be prevented. Also, the dielectric resonators can be held in the position rigidly.

In the second or third embodiment, the rectangular body resonators, such as used in the first embodiment, may be used in place of the cylindrical body resonators.

Figure 6:
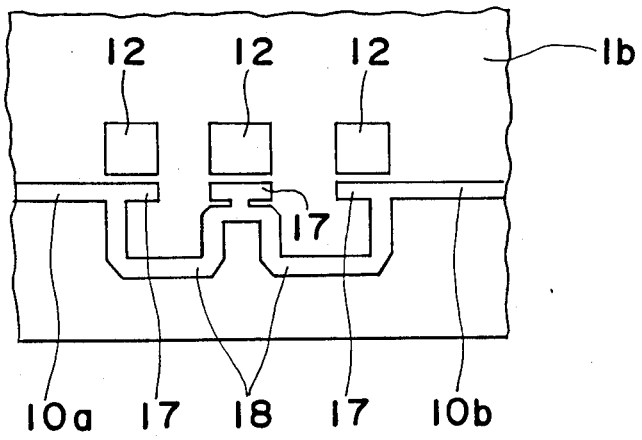
FIG. 6 is a top plan view of electrodes deposited on the circuit according to a modified form.

In the above described embodiments, the dielectric filters of band pass type are desribed. By changing the pattern of electrodes between input and output strip lines 10*a* and 10*b*, a band elimination type filter may be arranged. An example of electrode pattern for making a band elimination filter is shown in FIG. 6. The relationship between capacitance electrodes 12 and dielectric resonator 3 is the same as those described in the above embodiments. A bar electrode 17 is located closely adjacent each capacitance electrode 12 so that electrodes 12 and 17 are capacitively coupled. Bar electrodes 17 are connected serially by lines 18. Bar electrodes 17 at opposite ends are connected to input and output strip lines, respectively.

According to the present invention, since the dielectric filter is formed directly on a substrate on which the microwave integrated circuit is formed, the electric connection between the dielectric filter and the microwave integrated circuit may be done easily by the use of strip lines. Also, since the dielectric filter is not presented as a unit element, the filters will not be handled individually. Therefore, it is not necessary to provide a special shield casing for the dielectric filter. Also, it is not necessary to provide any sockets and pins, resulting in a low manufacturing cost. Also, the elimination of sockets and pins will result in easy impedance matching between the dielectric filter and the microwave integrated circuit.

Although the present invention has been fully described with reference to several preferred embodiment, many modifications and variations thereof will now be apparent to those skilled in the art, and the scope of the present invention is therefore to be limited not by the details of the preferred embodiments described above, but only by the terms of the appended claims.

What is claimed is:

1. A microwave integrated circuit including a dielectric filter, comprising:

a microwave integrated circuit substrate made of a dielectric material and having a microwave integrated circuit on at least one side of said substrate and which is complete except for a filter means;

input and output strip lines deposited on said substrate and extending from said microwave integrated circuit and having ends in spaced opposed relation along said substrate;

a ground electrode depositioned on the other side of said substrate opposite the space between the ends of said strip lines; and wherein said dielectric filter comprises at least one capacitance electrode deposited on said one side of said substrate between said input and output strip lines and being capacitively connected thereto; and at least one dielectric resonator mounted on said substrate, said dielectric resonator having a body made of a dielectric material with a hole therein, an inner electrode deposited on the inner surface of said body defining said hole, and an outer electrode deposited on the outer surface of said body, said inner electrode being electrically connected to said capacitance electrode and said outer electrode being electrically connected to said ground electrode.

2. A circuit as claimed in claim 1, wherein said body is an elongated cylindrical body.

3. A circuit as claimed in claim 1, wherein said body is an elongated rectangular body.

4. A circuit as claimed in claim 1, wherein said body is mounted on said substrate such that said hole extends parallel to said substrate.

5. A circuit as claimed in claim 1, wherein said dielectric resonator further has an electrode which connects said inner and outer electrodes.

6. A circuit as claimed in claim 1, further comprising a shield cover for covering said capacitance electrodes.

7. A circuit as claimed in claim 1, wherein said hole is a through hole.

8. A circuit as claimed in claim 1, wherein said filter is a band pass filter.

9. A circuit as claimed in claim 1, wherein said filter is a band elimination filter.

10. A circuit as claimed in claim 1, wherein said body is mounted on said substrate such that said hole extends perpendicular to said substrate.

11. A circuit as claimed in claim 10, wherein said body is mounted on an opposite surface to the surface on which said capacitance electrode is deposited.

12. A circuit as claimed in claim 11, further comprising a terminal tube made of electrically conductive material, said terminal tube extending through said substrate and having a first end portion inserted into said hole for effecting the electric connection with said inner electrode, and a second end portion electrically connected to said capacitance electrode.

13. A circuit as claimed in claim 10, wherein said body is mounted on the same surface as the surface on which said capacitance electrode is deposited.

14. A circuit as claimed in claim 13, further comprising:

a cover plate made of dielectric material, and having at least one opening therethrough, said cover plate mounted on said substrate so as to cover at least a portion of said input and output strip lines, with at least a portion of said capacitance electrode positioned within said opening; and a ground electrode deposited on outer surfaces of said cover plate other than one flat surface facing said substrate;

said ground electrode of said cover plate being electrically connected to said ground electrode of said substrate and also to said outer electrode of said dielectric resonator; and said dielectric resonator being inserted into said opening so as to rigidly support said dielectric resonator and to electrically connect said inner electrode with said capacitance electrode.

* * * * *